United States Patent [19]

Valesko

[11] 4,364,534

[45] Dec. 21, 1982

[54] PLASTIC BAG STAND

[76] Inventor: Thomas M. Valesko, 3012 Orleans Rd., Seneca Castle, N.Y. 14547

[21] Appl. No.: 259,992

[22] Filed: May 4, 1981

[51] Int. Cl.[3] ..... A63B 55/04

[52] U.S. Cl. ..... 248/97; 248/153

[58] Field of Search ..... 248/95, 97, 99, 100, 248/101, 153; 53/390; 141/314, 391; 232/43.2

[56] References Cited

U.S. PATENT DOCUMENTS

| | | | |
|---|---|---|---|
| 1,006,328 | 10/1911 | Widenhofer | 248/175 X |
| 3,632,010 | 1/1972 | Marty | 220/6 |
| 3,638,888 | 2/1972 | Ross | 248/175 X |
| 3,687,408 | 8/1972 | Lake | 248/97 |
| 3,737,129 | 6/1973 | Foster | 248/97 |
| 4,029,244 | 6/1977 | Roberts | 220/6 X |
| 4,062,170 | 12/1977 | Orem | 53/390 |
| 4,226,348 | 10/1980 | Dottor et al. | 220/6 X |

FOREIGN PATENT DOCUMENTS

| | | | |
|---|---|---|---|
| 1100926 | 5/1981 | Canada | 53/390 |
| 1444044 | 5/1966 | France | 248/447 |
| 598057 | 4/1978 | Switzerland | 248/97 |

OTHER PUBLICATIONS

Photograph Submitted by Applicant on May 4, 1981.

*Primary Examiner*—J. Franklin Foss

*Attorney, Agent, or Firm*—Stonebraker, Shepard & Stephens

[57] ABSTRACT

A plastic bag stand 10 is formed of wire to include a base 11 and generally U-shaped sides 12 and 13 pivotally mounted on the base to fold flat under the base for packaging and to open upright above the base for supporting the bag. The stand 10 has several improvements involving the way the base 11 is formed and the sides 12 and 13 are pivotally mounted on the base. The base is formed of opposed longitudinals 16 and 17 having central spans spaced apart by less than the width of the sides and a pair of opposed laterals 18 and 19 having mid-regions in the plane of the central spans of the longitudinals. End portions of the longitudinals are bent outward and downward to join the laterals, and S-curves 24 in the laterals make end regions 23 parallel with an offset from the mid-regions. Bonds 20 join the end regions of the laterals with the end portions of the longitudinals, and the sides are pivotally mounted on the end regions of the laterals between and adjacent the S-curves and the bonds. This allows the upper regions of the sides to detent against inside surfaces of the S-curves when folded and lower regions of the sides to detent against outside surfaces of the S-curves when opened upright.

7 Claims, 8 Drawing Figures

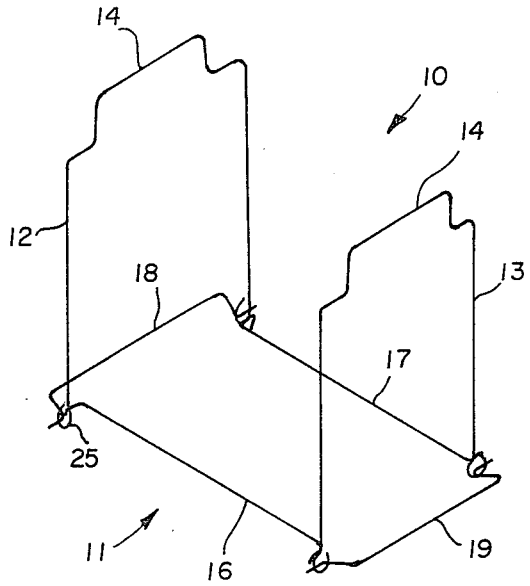
FIG. 1
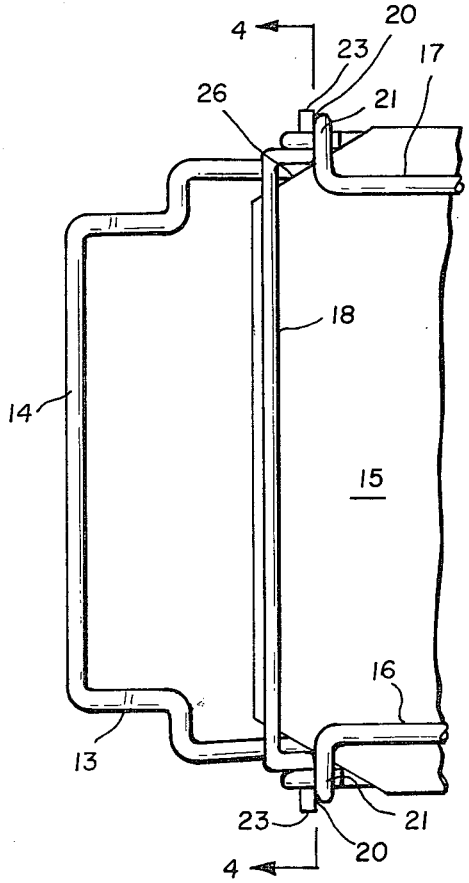
FIG. 3
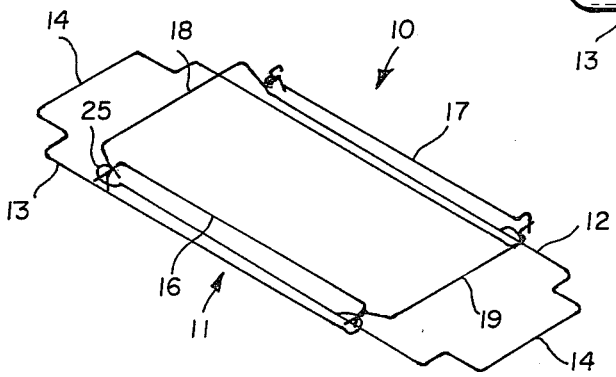
FIG. 2
FIG. 4
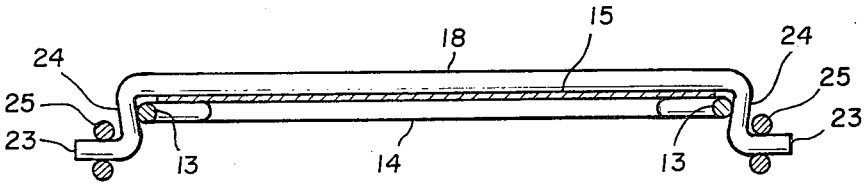

PLASTIC BAG STAND

BACKGROUND

Plastic grocery bags with handles are beginning to replace paper bags for groceries; and besides the necessary changes in stores to accommodate plastic bags, changes are also necessary for consumers who have used paper bags as liners for garbage and rubbish containers. The substitution of plastic for paper in grocery bags has thus led to a wire bag stand for holding a plastic grocery bag in an upright and open position to receive garbage and rubbish. The wire bag stand already developed for this purpose has a base welded in a closed rectangular loop and a pair of end wires welded to the base to provide vertical stops and detents for a pair of side frames pivotally mounted on the base to stand upright over the base and support the top of a plastic bag.

This invention involves recognition of several deficiencies of such a stand and includes improvements that make a better functioning stand that is more convenient to use and less expensive to make. The improvements include reducing the amount of wire and the number of welds, detenting the sides in a folded position to aid in packaging and shipping, a way of trapping a display card in the folded stand for marketing purposes, and convenient, single-handed unfolding to an opened position.

SUMMARY OF THE INVENTION

The invention applies to a plastic bag stand that is formed of wire to include a base and generally U-shaped sides that pivotally mount on the base to fold flat under the base and to open upright above the base to support a plastic bag. The inventive improvement involves the base region of the stand formed as a pair of opposed longitudinals having central spans spaced apart by less than the width of the sides and a pair of opposed laterals having mid-regions arranged approximately in the plane of the central spans of the longitudinals. End portions of the longitudinals are bent outward and downward to join the laterals, and end regions of the laterals are parallel with an offset from their mid-regions; and S-curves in the laterals join the mid-regions and the end regions. Bonds join the end regions of the laterals to the end portions of the longitudinals, and the sides are pivotally mounted on the end regions of the laterals between and adjacent the S-curves and the bonds. This allows the upper regions of the sides to detent against inside surfaces of the S-curves when folded and lower regions of the sides to detent against outside surfaces of the S-curves when opened upright. This arrangement also cooperates with other structural features to accomplish all the previously mentioned advantages.

DRAWINGS

FIG. 1 is a perspective view of a preferred embodiment of the inventive bag stand with sides opened upright above the base to support a plastic bag;

FIG. 2 is a perspective view of the stand of FIG. 1 with the sides folded under the base for packaging and shipment;

FIG. 3 is a fragmentary plan view of the stand of FIGS. 1 and 2 in folded position holding a display card;

FIG. 4 is a cross-sectional view of the stand of FIG. 3 taken along the line 4—4 thereof;

DETAILED DESCRIPTION

Figure 5:
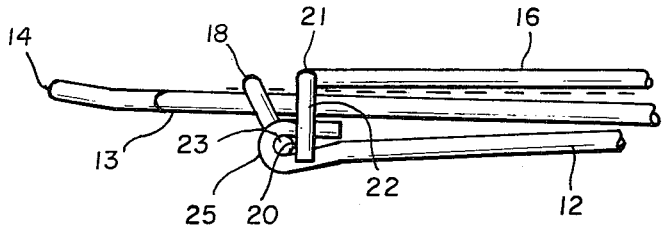
FIG. 5 is an enlarged fragmentary side elevational view of one corner of the stand in folded position.
Figure 6:
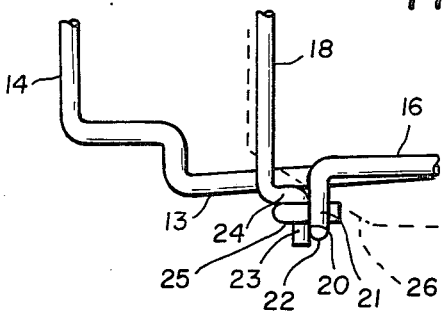
FIG. 6 is an enlarged fragmentary plan view of the corner of the stand shown in FIG. 5.

Bag stand 10 is formed of wire to include a base 11 and a pair of generally U-shaped sides 12 and 13 that are pivotally mounted to open upright above base 11 as shown in FIG. 1 and to fold flat under base 11 as shown in FIG. 2. The upper ends 14 of sides 12 and 13 engage the handles of a plastic bag (not shown) and support it in an open position above base 11 for receiving garbage or rubbish. Folding sides 12 and 13 under base 11 as shown in FIG. 2 makes stand 10 compact and nearly flat for packaging and shipment. The improvements in stand 10 involve the structure of base 11 and the mounting of sides 12 and 13 on base 11 as described below.

Base 11 is formed of a pair of opposed longitudinals 16 and 17 and a pair of opposed laterals 18 and 19 that are joined together in four bonds 20 preferably formed as spot welds. The central spans of longitudinals 16 and 17 and the mid-regions of laterals 18 and 19 all lie approximately in one plane and form a frame supporting one face of a display card 15. Longitudinals 16 and 17 and laterals 18 and 19 also form fixed pivots for sides 12 and 13, detents for both the folded and upright positions of the sides, and upright stops for the sides, besides forming a structurally rugged base 11.

The central spans of longitudinals 16 and 17 are spaced apart by less than the width of sides 12 and 13, and end portions of longitudinals 16 and 17 are bent outward at 21 and downward at 22 to join laterals 18 and 19 at bonds 20. Laterals 18 and 19 have end regions 23 joined to the down bends 22 of longitudinals 16 and 17 at bonds 20, and end regions 23 also form pivot journals for the lower ends of sides 12 and 13. End regions 23 are parallel with and offset from mid-regions of laterals 18 and 19, and between the mid-regions and end regions of the laterals are S-curves 24 that accomplish detenting and help with card holding.

Figure 7:
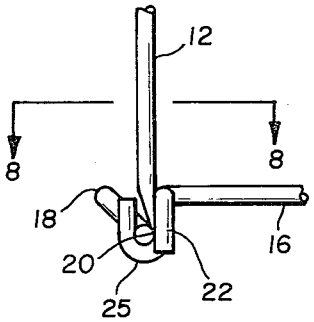
FIG. 7 is an enlarged fragmentary side elevational view of the corner of the stand shown in FIG. 5 with a side opened upright.
Figure 8:
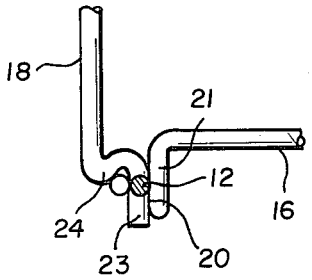
FIG. 8 is an enlarged cross-sectional view of the stand portion of FIG. 7 taken along the line 8—8 thereof.

Lower regions of sides 12 and 13 are bent into loops 25 that encircle journal ends 23 of laterals 18 and 19. This traps loops 25 between S-curves 24 and bonds 20 so that each loop 25 pivots in a fixed position on base 11. In a side upright position, each loop 25 detents against an outside surface of an S-curve 24 as best shown in FIGS. 7 and 8. The lower regions of sides 12 and 13 in the vicinity of loops 25 also bear against out bends 21 of longitudinals 16 and 17 for vertical stops that cooperate with the detenting of loops 25 against S-curves 24 to hold sides 12 and 13 in the upright position shown in FIG. 1.

When sides 12 and 13 are folded under base 11, they overlap and bend so their upper regions are detented against inside surfaces of S-curves 24 at opposite ends of base 11 as best shown in FIGS. 3–6. In this position, sides 12 and 13 retain card 15 in place by bearing against the face opposite the face engaging longitudinals and laterals 16–19. Card 15 also preferably has clipped corners 26 to engage in S-curves 24 and help hold card 15 within the frame of base 11.

The S-curves 24 of laterals 18 and 19 are preferably angled at about 45° to a plane through the central spans of longitudinals 16 and 17 and through the mid-regions of laterals 18 and 19. This positions S-curves 24 optimally for effective detenting of sides 12 and 13 in both open and folded positions. The lengths of laterals 18 and 19 and the widths of sides 12 and 13 can also be seleced for effective detenting in both open and folded positions.

Spacing the central spans of longitudinals 16 and 17 inside the pivot points for loops 25 on lateral end regions 23 not only allows out bends 21 to serve as upright stops for sides 12 and 13, but also keeps loops 25 toward the outside corners of the framework of base 11 to prevent tearing or grabbing plastic bags during use. Arranging the mid-regions of laterals 18 and 19 in the plane of the central spans of longitudinals 16 and 17 not only provides a supporting frame for display card 15, but also forms a secure bottom support for a plastic bag.

I claim:

1. A plastic bag stand formed of wire to include a base and generally U-shaped sides pivotally mounted on said base to fold flat under said base for packaging and to open upright above said base for supporting a plastic bag, said stand comprising:

a. a pair of opposed longitudinal wires having central spans spaced apart by less than the width of said sides;

b. a pair of oposed lateral wires having mid-regions arranged approximately in the plane of said central spans of said longitudinal wires;

c. end portions of said longitudinal wires being bent outward and downward to join said lateral wires;

d. end regions of said lateral wires being parallel with and offset from said mid-regions;

e. S-curves in said lateral wires between said mid-regions and said end regions;

f. bonds joining said end regions of said lateral wires and said end portions of said longitudinal wires at the lower ends of said downward bends in said longitudinal wires; and g. said sides being pivotally mounted on said end regions of said lateral wires between and adjacent said S-curves and said bonds so that upper regions of said sides detent against inside surfaces of said S-curves when folded and lower regions of said sides detent against outside surfaces of said S-curves when opened upright.

2. The stand of claim 1 wherein said S-curves lie in a plane inclined about 45° from said plane of said central spans of said longitudinal wires.

3. The stand of claim 1 wherein said outward bends of said end regions of said longitudinal wires form upright stops for said sides.

4. The stand of claim 1 wherein said central spans of said longitudinal wires and said mid-regions of said lateral wires form a card-holding frame, and said sides folded under said base trap a card against said frame.

5. The stand of claim 4 wherein clipped corners of said card fit against said S-curves to help hold said card in place.

6. The stand of claim 5 wherein said S-curves lie in a plane inclined about 45° from said plane of said central spans of said longitudinal wires.

7. The stand of claim 6 wherein said outward bends of said end regions of said longitudinal wires from upright stops for said sides.

* * * * *